United States Patent [19]

Bialek

[11] 4,272,360

[45] Jun. 9, 1981

[54] PROCESS FOR BREAKING EMULSIONS IN FLUIDS FROM IN SITU TAR SANDS PRODUCTION

[75] Inventor: Rene F. Bialek, Calgary, Canada

[73] Assignee: Texaco Canada Inc., Calgary, Canada

[21] Appl. No.: 133,168

[22] Filed: Mar. 24, 1980

[51] Int. Cl.[3] ..... C10G 33/04

[52] U.S. Cl. ..... 208/188; 166/267

[58] Field of Search ..... 208/188; 252/329; 166/267

[56] References Cited

U.S. PATENT DOCUMENTS 4,058,453 11/1977 Patel ..... 208/188

FOREIGN PATENT DOCUMENTS 2830637 4/1979 Fed. Rep. of Germany ..... 208/188

51-18281 2/1976 Japan ..... 252/329

647336 2/1979 U.S.S.R. ..... 208/188

*Primary Examiner*—Brian E. Hearn

*Attorney, Agent, or Firm*—Carl G. Ries; Robert A. Kulason; Henry W. Archer

[57] ABSTRACT

There is disclosed a process for breaking emulsions in fluids from in situ tar sands producing areas by adding thereto from 30 to 50 volume percent of a hydrocarbon diluent; an effective amount of a non-ionic water-soluble polyethylene oxide polymeric resin having a molecular weight in the range of 100,000 to 1,000,000 followed by the addition of 500 to 800 ppm of an alkali metal hydroxide which reacts with clays tending to stabilize the emulsion to prevent and remove clay deposits in the treating equipment. The hydroxide also enhances the ability of the resin to break the emulsion.

8 Claims, No Drawings

PROCESS FOR BREAKING EMULSIONS IN FLUIDS FROM IN SITU TAR SANDS PRODUCTION

BACKGROUND OF THE INVENTION

1. Field of the Invention

This invention is concerned with the resolution of water-bituminous emulsions stabilized with clay by treatment with polyethylene oxide; a hydrocarbon diluent and subsequently with sodium hydroxide serving as a secondary bitumen clean up chemical. The invention is also concerned with the separation of water from bitumen which has been brought to the surface in the form of oil-in-water-emulsions by an in-situ recovery process.

2. Prior Disclosures

Numerous hot water extraction methods exist for separating crude oil from bituminous sands (tar sands, oil sands and the like) which involve mixing such sands with hot or cold water and separating the sand from the resulting emulsions.

The technical difficulty encountered with emulsions produced by in-situ operations is that the liquid mixture is a highly stabilized emulsion which is difficult to break with standard treating chemicals.

Previous attempts to break emulsions resulting from hot water extraction processes are illustrated, inter alia, by the techniques described in U.S. Pat. Nos. 3,808,120, 3,607,721, and 3,487,003.

Thus, U.S. Pat. No. 3,808,120 describes a method for separating at least water and solids from the froth produced in a hot water process of separating bitumen from tar sands by treating the froth in at least one cyclone zone, after which it is treated in at least two centrifuging zones.

In U.S. Pat. No. 3,607,721 a process for the removal of solids and emulsified water from the bituminous emulsion is disclosed which comprises diluting the emulsion with a hydrocarbon diluent; maintaining the resulting mixture in a settling zone; removing the emulsion when substantially free of solids and emulsified water from the top of the settling zone; withdrawing settled sludge from the bottom of the settling zone and centrifuging the withdrawn sludge to separate bitumen and diluent from the settled solids and the emulsified water.

U.S. Pat. No. 3,487,003 describes a method for reducing the solids content of an effluent discharge from a hot water process for separating oil from bituminous sands by adding a flocculating agent which may be organic, inorganic or even a polyalkylene oxide of undisclosed molecular weight to this effluent; adjusting the pH of the effluent to less than 7.5 or more than 9 to effect flocculation of at least a portion of the solids therein; centrifuging the effluent now containing flocculated solids and recovering the effluent discharge substantially reduced in solids content. This method treats not an oil-in-water emulsion but rather an effluent comprised of the effluent from the sand tailing layer and the middlings layer. Further, there is no appreciation therein of the necessity for maintaining the temperature within a given range during treatment with the flocculating agent.

U.S. Pat. No. 2,964,478 describes a process for breaking an oil-in-water emulsion by subjecting the emulsion to the sole action of a polyalkylene oxide having a molecular weight of 100,000 to 3 million. In the practice of that process the mixture of the resin is allowed to stand quiescent for about 19 hours at a settling temperature ranging from room temperature to 160°, after which some of the oil rises to the surface of the pond or sump and is removed.

In U.S. Pat. No. 4,058,453 to Patel et al, there is disclosed a process for recovering oil from oil-in-water and water-in-oil emulsions by demulsifying the emulsions by adding thereto effective amounts of non-ionic, water-soluble polyethylene oxide polymers having a molecular weight in the range of 100,000 to 7,000,000, called "Polyox" and a calcium chloride and separating the oil from the water. Optionally in that process, the emulsions are diluted, following addition to the polymer, with from 30 to 50 volume percent of a hydrocarbon diluent and, after maintaining the temperature of the resulting mixture at between 150° and 210° F., the oil therein is centrifuged from the solids and the water.

SUMMARY OF THE INVENTION

The main object of this invention is to achieve functional demulsification of emulsions at a minimal cost and in a minimum amount of time.

This object is attained by the present invention which resides in the concept of demulsifying emulsions stabilized by clays, surfactants, both naturally occurring and those formed in situ and/or asphaltenes.

DISCLOSURE

In the present process, to the resulting oil-in-water emulsion at a pH in the range of about 7 to about 8, is added from about 10 to about 60 parts per million of an ethylene oxide polymer having a molecular weight in the range of 100,000 to 7,000,000. Particularly suitable polymers are those marketed under the trademarked name "Polyox". These are high polymers defined by the general formula $(O—CH_2—CH_2)_n$ with the degree of polymerization, "n", ranging from above 200 about 100,000 so as to give the above indicated molecular weight. These polymers, together with from 30 to 50 volume percent of a diluent such as toluene, diesel oil, fuel oil, kerosene and the like, are added and mixed with the bitumen-water emulsions after adding the "Polyox" resins at a temperature of about 150° F. to 240° F. and preferably 200° F. to 240° F.

At times, a stable inverted emulsion containing 10 to 50% water forms which regardless of "Polyox" concentration and treating residence time will not break. Unexpectedly, the use of an alkali metal hydroxide, preferably, sodium hydroxide, in concentrations of 500 to 800 ppm has consistently reduced the water content of this emulsion to 5% in the order of 2 to 4 hours, thus cutting down the residence time which normally requires weeks.

Since the NaOH appears to react with the clays which stabilize the emulsion, it not only prevents clay deposits from forming in pipes and vessels, but removes old deposits and buildups. For this reason, it can be employed as a clay deposit inhibitor and remover.

Mixing is carried out in steel treating vessels with the reagents added by any suitable means such as a proportioning pump. After the oil rises to the surface of the fluid, it is removed by means of an overflow weir. The separated water, containing very little of the previously emulsified oil, can be discarded, or reconstituted with brine and recycled. Its pH after the emulsion is broken ranges from about 10.0 to 10.5.

With the addition of hydroxide, a narrow and stable interface has been observed to form. Without such addition an unstable oil/water interface exists making control of the treating vessel very difficult.

What is claimed is:

1. A process for recovering oil from an oil-in-water emulsion stabilized by clay and other solids comprising the steps of: subjecting said emulsion to the action of an effective emulsion-breaking amount of non-ionic, water-insoluble polyethylene oxide polymers having a molecular weight in the range of 100,000 to 7,000,000, diluting said emulsion with 30 to 50 volume percent of a hydrocarbon diluent, maintaining the temperature of the resulting mixture between about 150° F. and about 240° F.; thereafter adding to said mixture an effective, clay deposit-inhibiting and -removing amount of an alkali metal hydroxide; allowing the resulting system to remain in the quiescent state for about 2 to about 6 hours, and thereby separating said oil from said system.

2. The process of claim 1, further including the step of removing said oil from said system.

3. The process of claim 1, wherein the emulsions, the polymers and said solution are maintained in contact at a temperature in the range of about 200° to about 240° F.

4. The process of claim 1, wherein said emulsions are production fluids produced by an in-situ recovery operation.

5. The process of claim 1, wherein from 10 to 2,000 parts per million of resin are added on the basis of the volume of emulsion.

6. The process of claim 1, wherein from 500 to 800 parts per million of sodium hydroxide are added.

7. The process according to claim 1, carried out at a pH of about 7.0 to about 8.0.

8. The process of claim 1, wherein said diluent is toluene, diesel oil, fuel oil or kerosene.

* * * * *